US006459373B1

(12) United States Patent
Edwards

(10) Patent No.: US 6,459,373 B1
(45) Date of Patent: Oct. 1, 2002

(54) VEHICLE DOOR HANDLE

(75) Inventor: Paul K. Edwards, Norwich (GB)

(73) Assignee: Breed Automotive Technology Inc., Lakeland, FL (US)

( * ) Notice: Subject to any disclaimer, the term of this patent is extended or adjusted under 35 U.S.C. 154(b) by 36 days.

(21) Appl. No.: 09/644,373

(22) Filed: Aug. 23, 2000

(30) Foreign Application Priority Data

Sep. 1, 1999 (GB) ..... 9920589

(51) Int. Cl.[7] ..... G08B 13/08

(52) U.S. Cl. ..... 340/547; 340/426; 340/457; 70/264

(58) Field of Search ..... 340/547, 542, 340/426, 457; 70/264

(56) References Cited

U.S. PATENT DOCUMENTS

| | | | | |
|---|---|---|---|---|
| 4,249,161 A | | 2/1981 | Mohnhaupt | 340/52 D |
| 4,565,994 A | | 1/1986 | Mochida et al. | 340/542 |
| 4,738,334 A | | 4/1988 | Weishaupt | 180/287 |
| 4,983,947 A | * | 1/1991 | Mullen et al. | 340/426 |
| 5,121,098 A | * | 6/1992 | Chen | 340/457 |
| 5,656,990 A | | 8/1997 | Schwimmer | 340/426 |
| 5,878,610 A | * | 3/1999 | Friedrich | 70/264 |
| 5,890,384 A | * | 4/1999 | Bartel et al. | 70/264 |
| 6,137,419 A | | 10/2000 | Lennox et al. | 340/687 |
| 6,304,177 B1 | * | 10/2001 | Nigro, Jr. et al. | 340/542 |

FOREIGN PATENT DOCUMENTS

| | | |
|---|---|---|
| EP | 0916789 | 5/1999 |
| WO | WO9941475 | 8/1999 |

* cited by examiner

*Primary Examiner*—John Tweel
(74) *Attorney, Agent, or Firm*—Lonnie Drayer; Jarett Rieger

(57) ABSTRACT

A vehicle door handle has a fixed part, a movable part and a sensor. The sensor is a magnet and a magnet-actuated switch. Movement of the movable part relative to the fixed part causes the magnet to activate the switch. A flux blocker is arranged between the magnet and the switch to prevent magnetic flux from the magnet actuating the switch. The flux blocker is arranged to expose the switch to magnetic flux when the movable part moves relative to the fixed part.

10 Claims, 7 Drawing Sheets

VEHICLE DOOR HANDLE

FIELD OF THE INVENTION

The invention relates to a sensor in a vehicle door handle, particularly to but not exclusively limited to a sensor in a passenger vehicle door handle.

BACKGROUND OF THE INVENTION

Keyless entry systems to vehicles generally comprise an RF receiver in the vehicle tuned to a particular frequency and an RF transmitter tuned to the same frequency. The owner of the vehicle locks and unlocks the vehicle and/or activates and deactivates the vehicle alarm or immobilizer system using the RF transmitter.

After the vehicle has been locked and the alarm activated by the user, the electronics of the vehicle are still active and it has been proposed to deactivate the electronics in some way so as to effect an electronic "deadlocking" of the vehicle.

SUMMARY OF THE INVENTION

According to one aspect of the invention there is provided a sensor in a vehicle door handle. The handle comprises a fixed part and a movable part. The sensor comprising a magnet and a magnet-actuated switch whereby movement of the movable part relative to the fixed part causes the magnet to activate the switch.

In that way a system can be provided in which actuation of the vehicle door handle activates or deactivates the vehicle's electronics.

Preferably, the sensor comprises a flux blocking means arranged between the magnet and the switch to prevent magnetic flux from the magnet actuating the switch. The blocking means may be arranged to expose the switch to magnetic flux when the movable part moves relative to the fixed part of the hand. The flux blocking means may comprise a vane of flux blocking material arranged between the magnet and the switch.

Preferably, two switches are provided, one arranged on each side of the magnet. In such a case, two flux blocking means may be provided, each flux blocking means being arranged between the magnet and a respective switch. Preferably, where two switches and two flux blocking means are provided, the sensor is arranged such that one switch is actuated by movement of the movable part relative to the fixed part in a first direction. The other switch is actuated by movement of the movable part relative to the fixed part in the opposite direction.

In another embodiment, the magnet is arranged on one of the fixed part and movable part and the magnet-actuated switch is arranged on the other of the fixed part and movable part. The sensor being arranged such that at a rest position of the movable part the magnet does not interact with the switch and movement of the movable part relative to the fixed part causes the magnet to actuate the switch. Preferably, two switches are provided. The sensor being arranged such that at the rest position of the movable part relative to the fixed part neither switch is actuated and so that movement of the movable part relative to the fixed part in one direction actuates one switch and movement of the movable part relative the fixed part in the opposite direction actuates the other switch. Preferably, the magnet is arranged on the movable part and each switch is arranged on the fixed part.

The magnet-actuated switch is preferably a reed switch. Alternatively, a Hall effect switch or a giant magneto resistive (GMR) can be used.

Preferably, the sensor can be retrofitted to an existing vehicle door handle.

According to another aspect of the invention, there is provided a vehicle door handle comprising a fixed part, a movable part and a sensor. The sensor comprising a magnet and a magnet-actuated switch whereby movement of the movable part relative to the fixed part causes the magnet to actuate the magnet-actuated switch.

According to a further aspect of the invention there is provided a sensor for a vehicle door handle comprising a magnet, a magnet-actuated switch and means for blocking magnetic flux arranged between the magnet and the magnet-actuated switch. The magnet and magnet-actuated switch are arranged on the movable part and fixed part and the flux blocking means is arranged on the other of the movable part and fixed part so that movement of the movable part relative to the fixed part moves the flux blocking means relative to the magnet and magnet-actuated switch so as to expose the magnet-actuated switch to magnet flux from the magnet, thereby actuating the magnetic actuated switch.

DETAILED DESCRIPTION OF THE INVENTION

Figure 1:
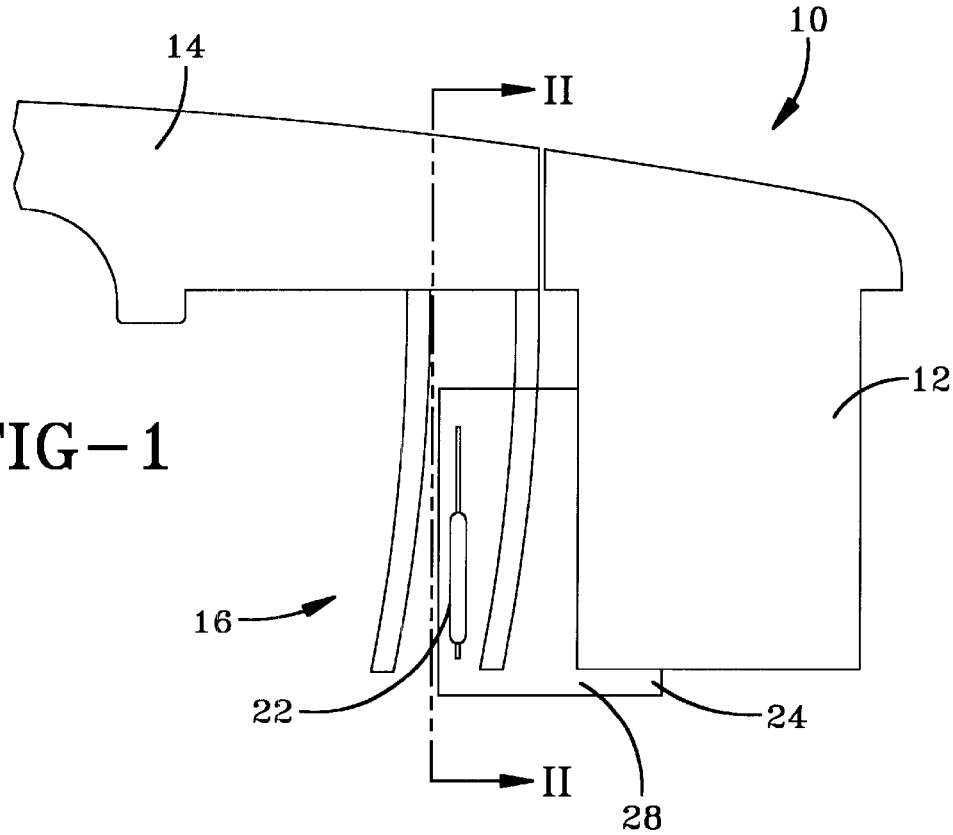
FIG. 1 is a schematic side elevation of part of a vehicle door handle including a sensor in accordance with the invention.
Figure 2:
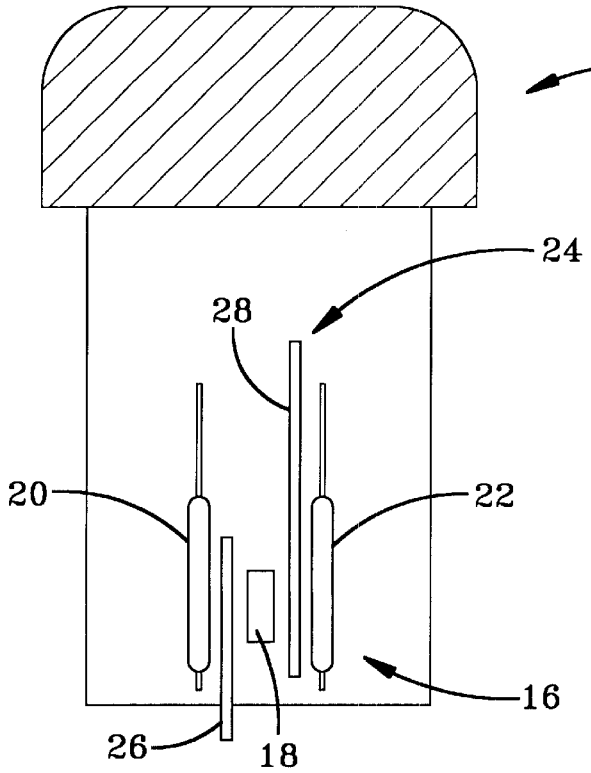
FIG. 2 is a schematic cross section taken on line II—II in FIG. 1.
Figure 3:
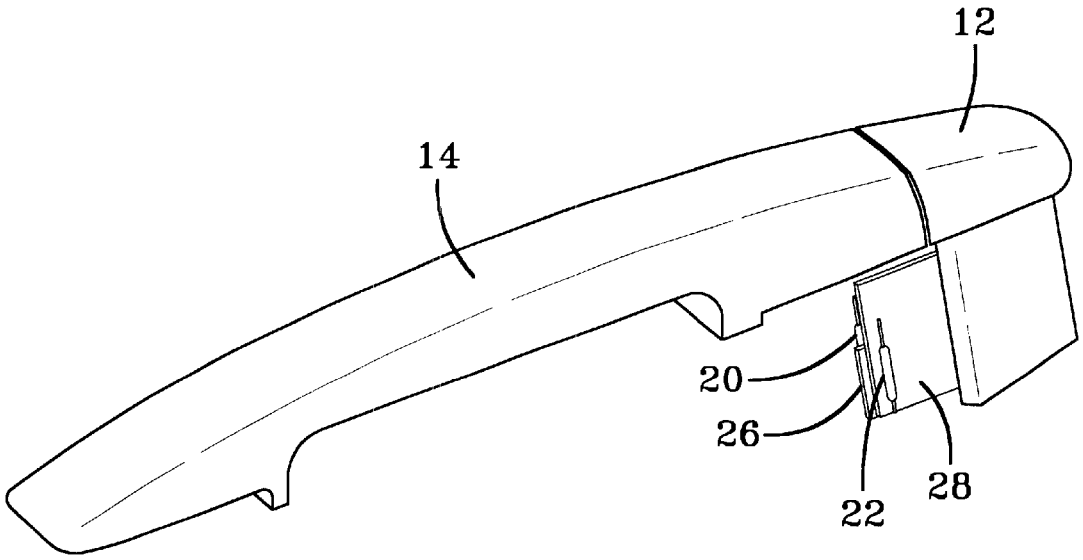
FIG. 3 is a perspective view of part of a vehicle door handle including a sensor as shown in FIG. 1.
Figure 4:
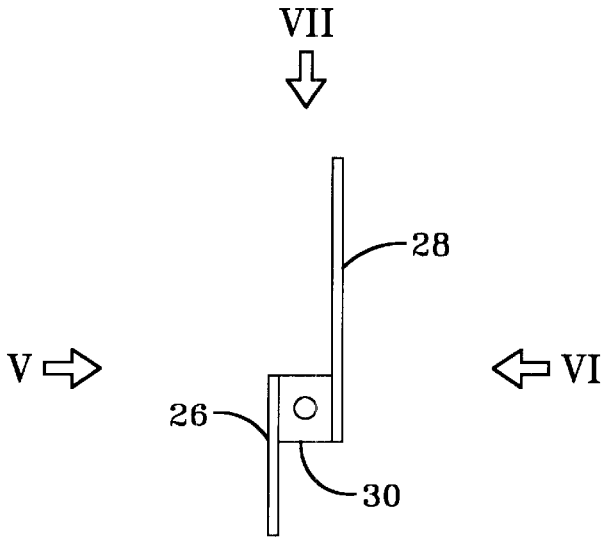
FIG. 4 is an end elevation of a vane for use in the sensor shown in FIGS. 1, 2 and 3.
Figure 5:
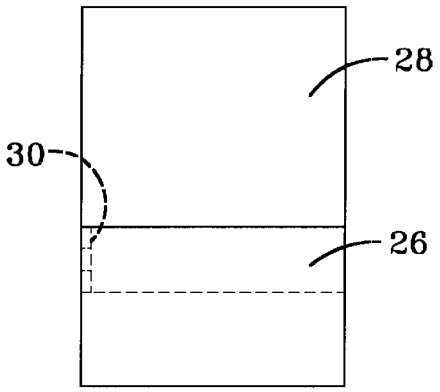
FIG. 5 is a side elevation of the vane of FIG. 4 looking in the direction of arrow V in FIG. 4.
Figure 6:
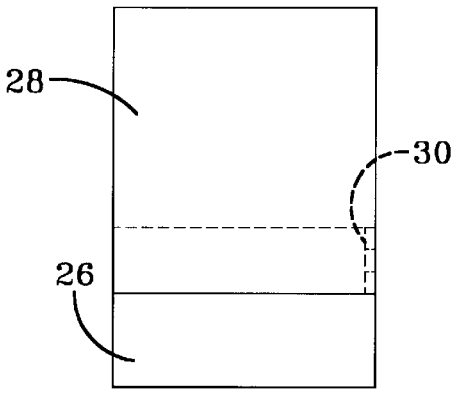
FIG. 6 is a side elevation of the vane shown in FIG. 4 looking in the direction of arrow VI in FIG. 4.
Figure 7:
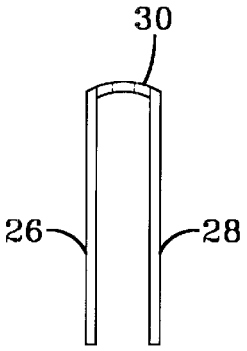
FIG. 7 is a plan view of the vane in FIGS. 4, 5 and 6 looking in the direction of arrow VII in FIG. 4.

Referring to FIG. 1, a vehicle door handle 10 comprises a fixed part 12 and a movable part 14. The movable part is grasped by a user and is pulled away from the door of the vehicle to actuate the latching mechanism of the door. A sensor arrangement 16 comprising a magnet and a magnet-actuated switch is arranged with the handle 10. The sensor arrangement comprises a magnet 18 arranged on the movable part 14 of the handle. In this embodiment the magnet-actuated switch comprises two reed switches 20, 22 that are arranged on the movable part 14 of the handle, one on each side of the magnet 18 and a vane member 24 is arranged on the fixed part 12 of the handle. The magnet-actuated switch may alternatively comprise one or more Hall Effect switches or giant magneto resistors (GMR) could be used in place of the reed switches.

Figure 8:
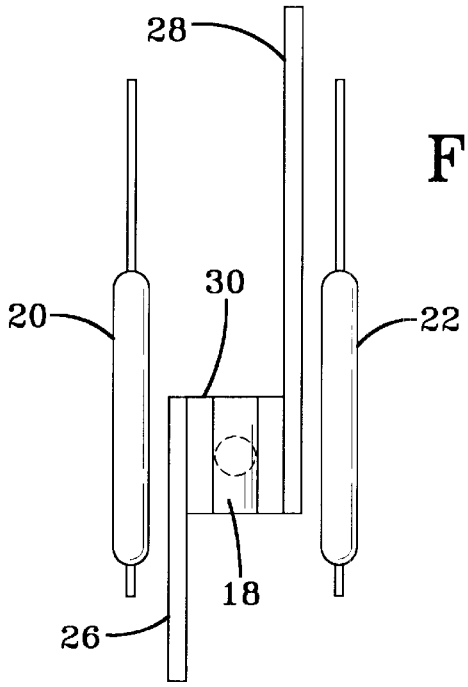
FIGS. 8, 9 and 10 are schematic elevations of the sensor of FIGS. 1, 2 and 3 operating in "unlock" mode.

The vane member 24, as shown in FIGS. 4 to 7, comprises a first vane 26. A second vane 28 is spaced apart from the first vane and a connecting member 30 connects the vanes together. The first vane 26 is arranged between the reed switch 20 and the magnet 18 and extends just above the magnet when the movable part 14 of the handle 10 is in the rest position as shown in FIG. 8. The second vane 28 is arranged between the magnet 18 and the reed switch 22 and extends just below the magnet when the movable part 14 of the handle is in the rest position as shown in FIG. 8. The first vane 26 extends for some distance below the magnet 18 and the second vane 28 extends for some distance above the magnet as shown in FIG. 8.

The sensor arrangement 16 is intended to be used to activate or deactivate the vehicle's electronics in response to pulling or depressing the vehicle door handle. The operation of the sensor is illustrated in detail in FIGS. 8 to 13. The reed switches 20, 22 and magnet 18 are arranged on the movable part 14 of the handle 10. Consequently, the magnet and switches move and the vane members 26, 28 are held fixed by the fixed member 12. In FIGS. 8 to 13, the movement of the magnet 18 and switches 20,22 have been illustrated as relative movement of the vane member 24.

Figure 9:
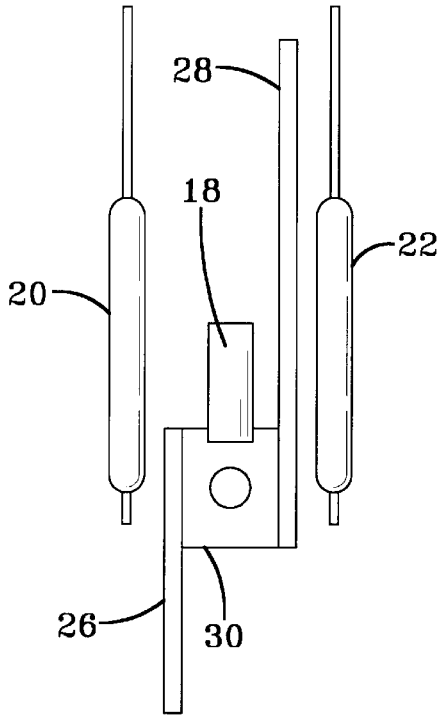
Figure 10:
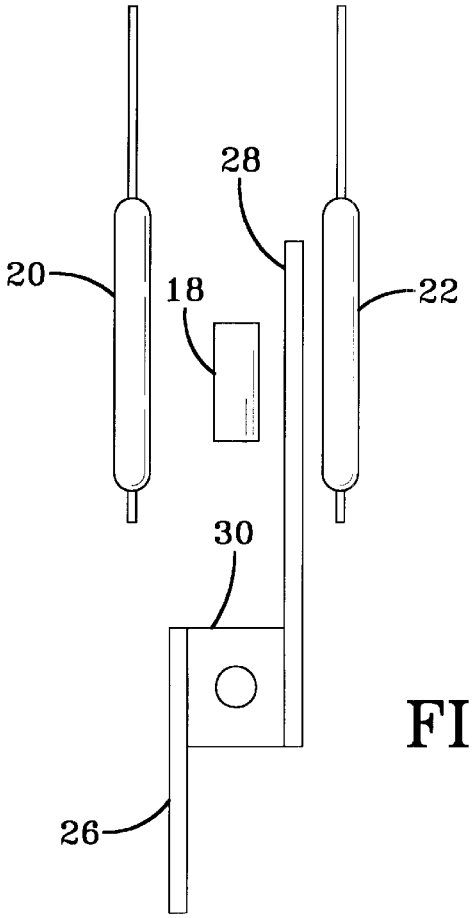

FIGS. 8 to 10 illustrate the operation of the sensor to activate the reed switch 20. FIG. 8 illustrates the sensor arrangement 16 at the rest position of the movable part 14 of the handle 10.

Flux blocking means in the form of vane members 26, 28 are positioned to block the flux from the magnet 18 to prevent the flux from interacting with the reed switches 20,22. In FIG. 9 the movable part of the handle has been pulled away slightly from the body of the vehicle to move the magnet and switches relative to the vane member. The vane 28 is still arranged between the magnet and reed switch 22 to prevent interaction between the magnetic flux of the magnet 18 and reed switch 22, but the vane 26 has moved away from the reed switch 20 so that part of the reed switch 20 is exposed to the magnetic flux of the magnet 18. It should be noted that the reed switches 20,22 and magnet 18 are calibrated so that as soon as a reed switch is exposed to magnet flux of the magnet the reed switch is activated. Consequently, in FIG. 9, the reed switch 20 has been activated.

The movable part 14 of the handle 10 continues to move away from the body of the vehicle and the fixed part 12 until it reaches the position illustrated in FIG. 10. In FIG. 10 the vane 26 is moved totally out of the space between magnet 18 and reed switch 20 but the vane 28 is still arranged between the magnet 18 and the reed switch 22. Consequently, pulling the movable part of the handle away from the vehicle body causes the reed switch 20 to be actuated by the magnet and actuation occurs after only a small movement of the movable part 14 for the full travel of the movable part. The reed switch 20 can be attached to initiating means to activate the vehicle's electronics.

Figure 11:
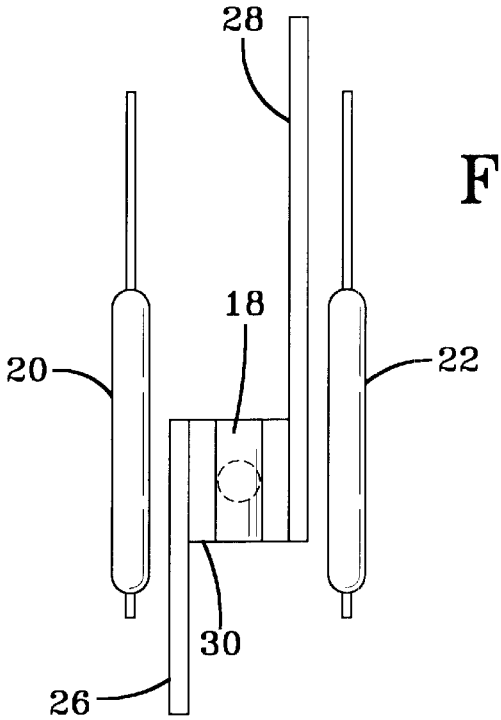
FIGS. 11, 12 and 13 are schematic elevations of the sensor of FIGS. 1, 2 and 3 in "lock" mode.
Figure 12:
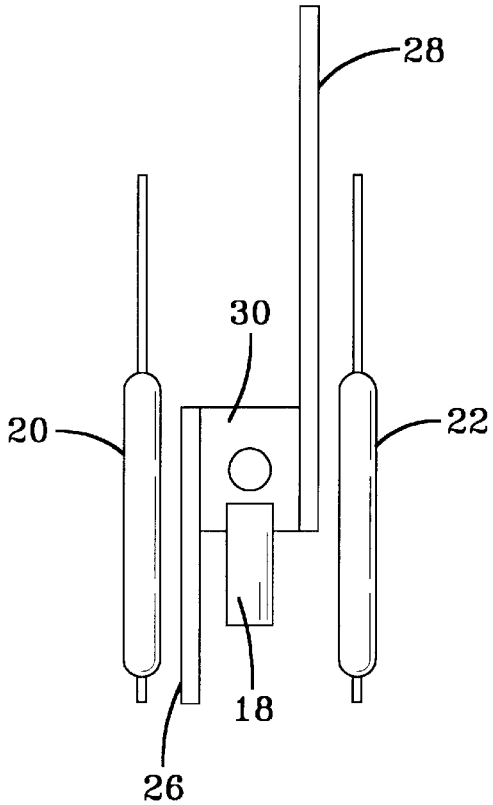
Figure 13:
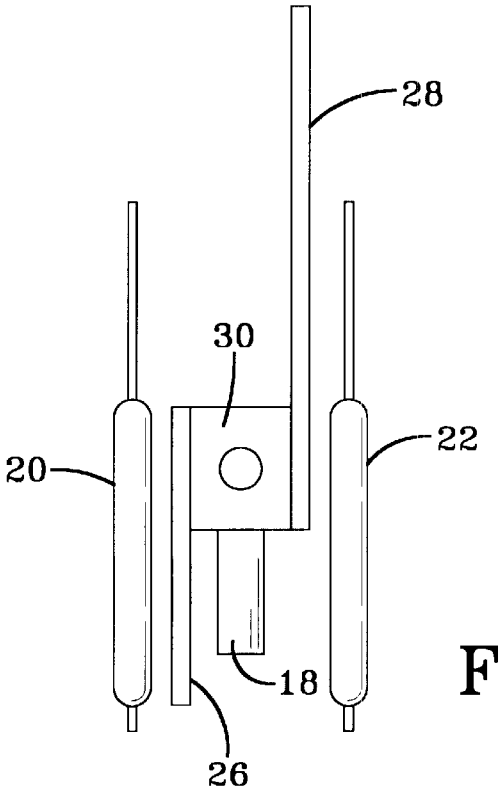

FIGS. 11 to 13 illustrate the actuation of the sensor in the opposite direction to that shown in FIGS. 8 to 10. FIG. 11 illustrates the sensor arrangement in the condition where the movable part 14 is in its rest position relative to the fixed part 12. In FIG. 12, the movable part 14 has been depressed relative to the fixed part 12 so as to move the movable part towards the vehicle body. This has the effect of moving the vane 28 out of the space between the magnet 18 and reed switch 22 so that the magnet interacts with the reed switch 22. FIG. 13 illustrates the sensor arrangement of the full depression of movable part 14 relative to the fixed part 12. The vane 28 is substantially moved out of the space between magnet 18 and reed switch 22 but the vane 26 remains in a position to prevent interaction between the magnet 18 and reed switch 20. Reed switch 22 can be connected to means to deactivate the vehicle's electronics.

Figure 14:
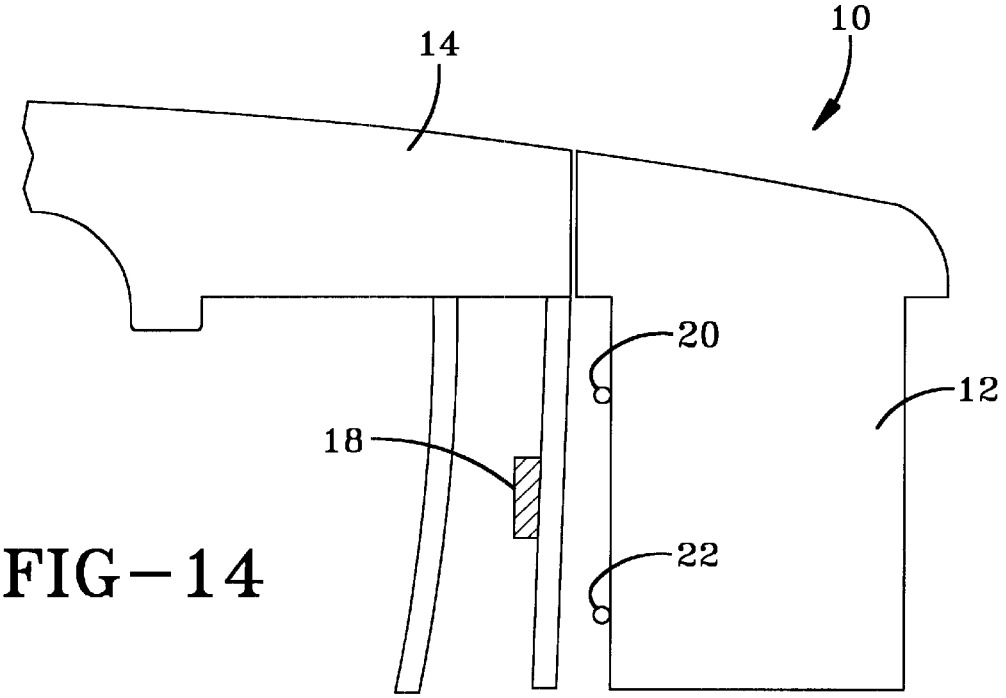
FIG. 14 is a schematic side elevation of a vehicle door handle in accordance with the invention showing an alternative arrangement of a sensor in accordance with the invention.

FIG. 14 shows an alternative embodiment of a sensor in accordance with the invention. Parts corresponding to parts in FIGS. 1 to 14 carry the same reference numerals. In FIG. 14 the magnet 18 is mounted on the movable part 14 of the handle 10 and two reed switches 20, 22 are mounted spaced apart on the fixed part 12 of the handle. The magnet 18 and reed switches 20, 22 are arranged so that in the rest position of the movable part 14 relative to the fixed part 12 the magnet does not interact with either reed switch. As the movable part 14 is pulled away from the vehicle body (not shown) the magnet moves into a position where it actuates reed switch 20 so that the vehicle's electronics is activated. When the movable part 14 returns to the rest position, the reed switch 20 is no longer actuated. When the movable part 14 is depressed relative to the fixed part 12 to move towards the vehicle body (not shown) the magnet 18 actuates the reed switch 22, which in turn acts to deactivate the vehicle's electronics.

Figure 15:
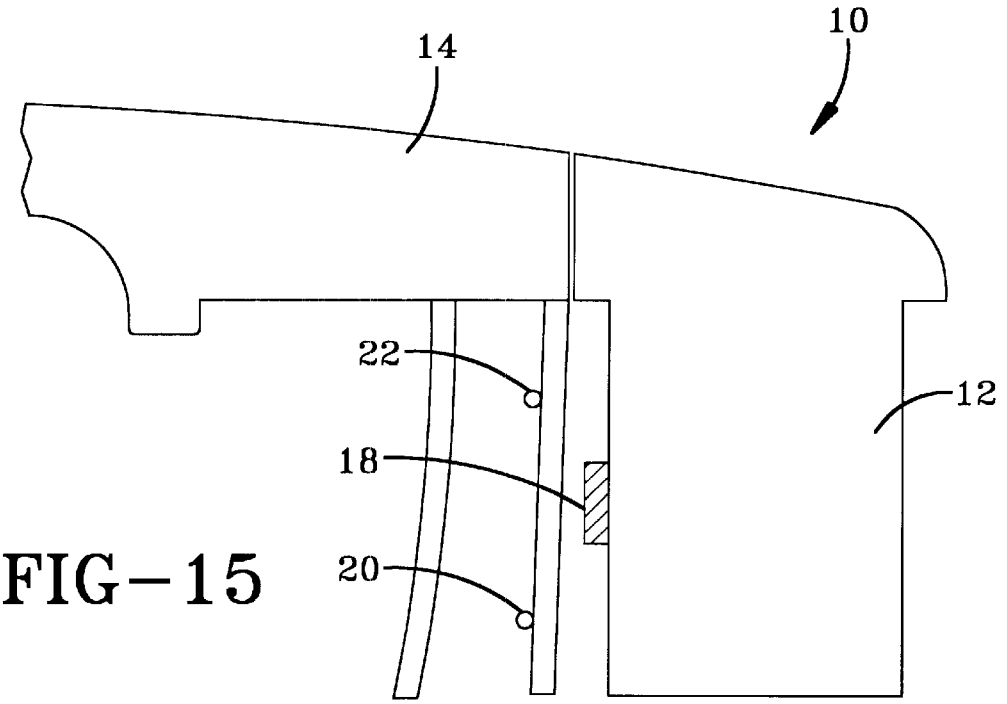
FIG. 15 is a schematic side elevation of a vehicle door handle showing a further sensor in accordance with the invention.

FIG. 15 shows a further embodiment of the invention similar to the embodiment shown in FIG. 14 and parts corresponding to parts in FIG. 14 carry the same reference numerals. The device of FIG. 15 is substantially similar to that shown in FIG. 14 with the exception that the magnet 18 is arranged on the fixed part 12 and the reed switches 20, 22 are arranged on the movable part. To ensure that the pulling of the vehicle handle 14 actuates the vehicle's electronics, the reed switches 20, 22 are inverted relative to the FIG. 14 embodiment. In that way pulling the movable part 14 of the handle 10 results in the reed switch 20 being brought into interaction with the magnet 19 while depression of the movable part 14 relative to the fixed part 12 brings the reed switch 22 into interaction with the magnet 18.

As will be appreciated, Hall effect switches or giant magneto resistor (GMR) switches can be substituted for reed switches in any of the foregoing embodiments.

Figure 16:
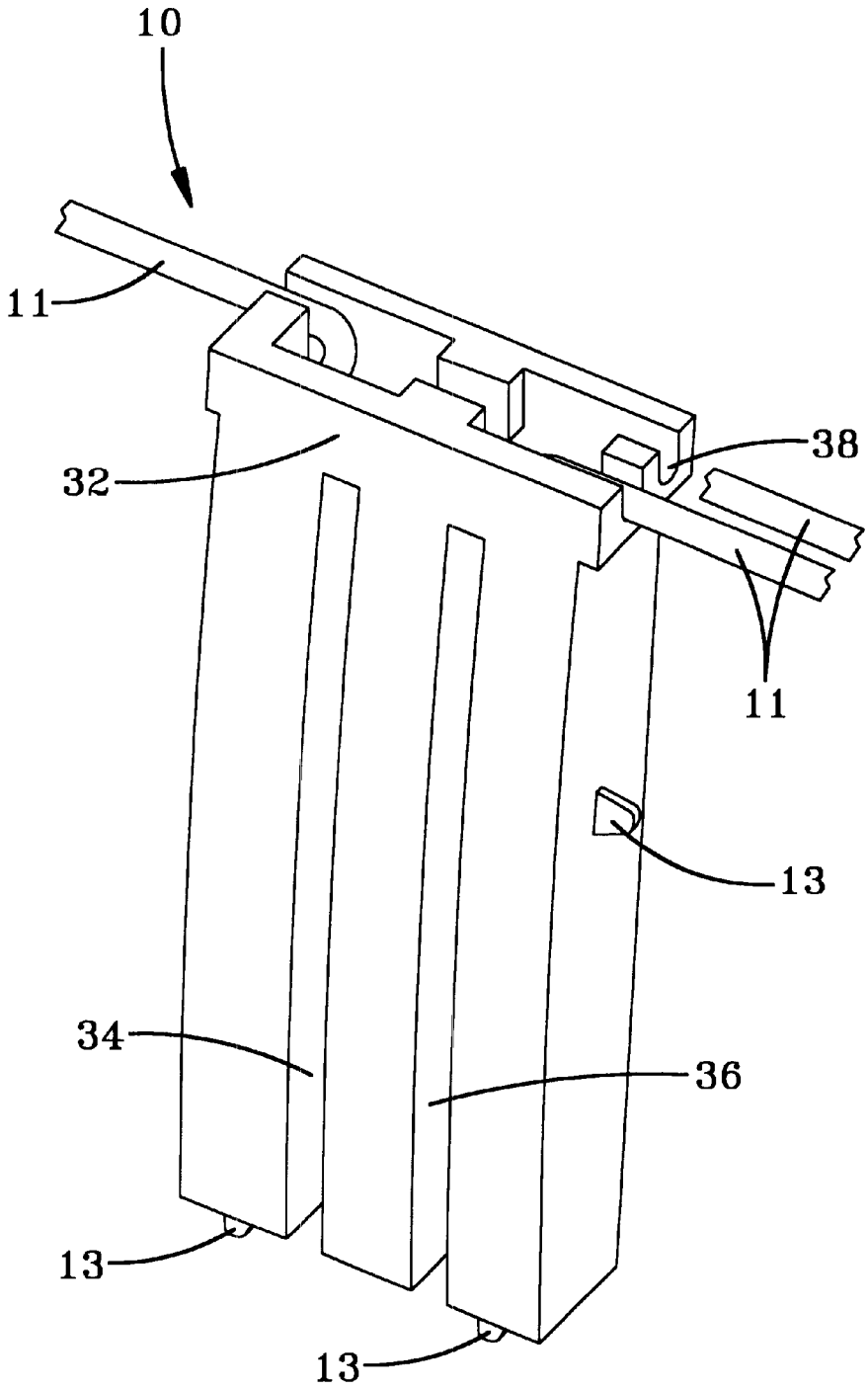
FIG. 16 is a perspective view of part of a vehicle door handle including part of a sensor in accordance with the invention.

In FIG. 16 a vehicle door handle 10 is shown only in part and parts corresponding to parts in FIGS. 1 to 15 carry the same reference numerals. In particular, only a portion of the movable part 14 of the handle 10 is shown. As with the previous embodiments, the movable part 14 carries the magnet and switch arrangement. In the embodiment of FIG. 16 the magnet and reed switches (not shown) are enclosed within a molding 32. The molding retains the magnet and switches in fixed relation to each other. Two slots 34, 36 in the molding are arranged to receive the vanes 26, 28 and accommodate the travel of the vanes during movement of the movable part 14 relative to the fixed part 12. The molding 32 has a passageway 38 for receiving leads 11 from the reed switches.

The movable part 14 of the handle 10 has four clip members 13, two on each side thereof, which extend toward the fixed part (not shown) of the handle. Each clip member comprises an elongate body extending from the movable part 14 and a tang extending from the free end of the elongate body inwardly of the movable part 14.

To assemble the molding 32 onto the movable part 14 of the handle 10, the molding is pushed onto the movable part so that the clip members 13 bend outwardly. The molding 32 is received between the clip members. By pushing the molding between the clip members, the members bend outwardly until the molding is accommodated between the clip members and the tangs of the clip members snap into the recessed portions of the molding. This renders assembly and correct location of the molding on the handle straightforward.

To assemble the molding 32 onto the movable part 14 of the handle 10, the molding is pushed onto the movable part so that the clip members 44, 46, 48 50 bend outwardly. The molding 32 is received between the clip members. By pushing the molding between the clip members, the members bend outwardly until the molding is accommodated between the clip members and the tangs 54 of the clip members snap into the recessed portions 40, 42 of the molding. This renders assembly and correct location of the molding on the handle straightforward.

Many changes and modifications in the above described embodiments of the invention can, of course, be carried out without departing from the scope thereof. Accordingly, that scope is intended to be limited only by the scope of the appended claims.

I claim:

1. A vehicle door handle comprising:

(a) a fixed part;

(b) a movable part; and, (c) a sensor comprising a magnet and two magnet-actuated switches whereby movement of the movable part relative to the fixed part causes the magnet to activate the magnet-actuated switch, wherein the switches are arranged on each side of the magnet; and (d) two flux blocking means are arranged between the magnet and the respective switch to prevent magnetic flux from the magnet actuating the magnet-actuated switch, the flux blocking means exposes the switch to magnetic flux when the movable part moves relative to the fixed part.

2. The vehicle door handle according to claim 1 wherein the sensor is arranged such that one switch is actuated by movement of the movable part relative to the fixed part in a first direction and the other switch is actuated by movement of the movable part relative to the fixed part in the opposite direction.

3. The vehicle door handle according to claim 1 wherein the magnet is arranged on one of the fixed art and movable part and the magnet-actuated switch s arranged on the other of the fixed part and movable art.

4. The vehicle door handle according to claim 3 herein the sensor is arranged such that at a rest position of the movable part the magnet does not interact with the magnet-actuated switch and movement of the movable part relative to the fixed part causes the magnet to actuate the magnet-actuated switch.

5. The vehicle door handle according to claim 1 wherein the sensor is arranged such that at the rest position of the movable part relative to the fixed part neither switch is actuated and so that movement of the movable part relative to the fixed part in one direction actuates one magnet-actuated switch and movement of the movable part relative the fixed part in the opposite direction actuates the other magnet-actuated switch.

6. The vehicle door handle according to claim 5 wherein the magnet is arranged on the movable part and each magnet-actuated switch is arranged on the fixed part.

7. The vehicle door handle according to claim 1 wherein the magnet-actuated switch is a reed switch.

8. The vehicle door handle according to claim 1 wherein the magnet-actuated switch is a Hall effect switch.

9. The vehicle door handle according to claim 1 wherein the magnet-actuated switch is a giant magneto resistive (GMR) switch.

10. A sensor for a vehicle door handle comprising a magnet, two magnet-actuated switches arranged on each side of the magnet, and two means for blocking magnetic flux, each flux blocking means arranged between the magnet and the respective magnet-actuated switch, the magnet and the magnet-actuated switches being arranged on one of the movable part and fixed part and the flux blocking means being arranged on the other of the movable part and fixed part so that movement of the movable part relative to the fixed part moves the flux blocking means relative to the magnet so as to expose one of the magnet-actuated switches to magnet flux from the magnet, thereby actuating the magnetic actuated switch.

* * * * *